US006675820B2

(12) United States Patent
Balan

(10) Patent No.: US 6,675,820 B2
(45) Date of Patent: Jan. 13, 2004

(54) SAFETY SUPPORT DEVICE WITH ADJUSTABLE ARM SUPPORT MEMBERS & METHOD

(76) Inventor: Ruben Balan, 1125 N. Broadway #E-201, Escondido, CA (US) 92086

( * ) Notice: Subject to any disclaimer, the term of this patent is extended or adjusted under 35 U.S.C. 154(b) by 75 days.

(21) Appl. No.: 09/920,596

(22) Filed: Aug. 1, 2001

(65) Prior Publication Data

US 2001/0045227 A1 Nov. 29, 2001

Related U.S. Application Data

(63) Continuation-in-part of application No. 09/510,421, filed on Feb. 22, 2000.

(60) Provisional application No. 60/121,252, filed on Feb. 23, 1999.

(51) Int. Cl.[7] ..... A61H 3/00

(52) U.S. Cl. ..... 135/67; 135/67; 135/85; 135/82; 135/71; 135/72; 135/73; 280/87.01; 280/87.051; 280/87.041; 16/24; 16/25; 16/44

(58) Field of Search ..... 135/67, 85, 82, 135/71, 72, 73; 280/87.01, 87.051, 87.041; 16/24, 25, 44

(56) References Cited

U.S. PATENT DOCUMENTS

| | | | | | |
|---|---|---|---|---|---|
| 4,180,086 | A | * | 12/1979 | Thomas | 135/67 |
| 4,742,838 | A | * | 5/1988 | Muiza et al. | 135/67 |
| 4,993,446 | A | * | 2/1991 | Yarbrough | 135/67 |
| 5,275,187 | A | * | 1/1994 | Davis | 135/67 |
| 5,692,762 | A | * | 12/1997 | Obitts | 280/87.05 |

* cited by examiner

*Primary Examiner*—Carl D. Friedman
*Assistant Examiner*—Steve M Varner
(74) *Attorney, Agent, or Firm*—John J. Connors; Connors & Assoc., Inc.

(57) ABSTRACT

The safety support device of this invention includes a frame having a mounting section. A pair of forward legs are attached to a forward end of the mounting section and a pair of rear legs are attached to a rear end of the mounting section. Each leg has a distal end to which is attached a roller assembly that includes a roller member mounted so that with the weight of the user bearing down on the assembly the roller member is prevented from moving. In a second embodiment used to assist injured or elderly person stand erect, the legs are long and arm support members engage the arm pits of the user when the user is being supported by the device. A third embodiment employs a manually release mechanism associated with each under arm support member that enables the user while standing erect to change the position of the under arm support members

16 Claims, 17 Drawing Sheets

64
90
82b
82a
90
82a
8A
72b
72a
104
7
8
105
7
100
8
102
100c
100b
60
70b
100
78
70a
78
78a
78b
78
76
78
76
80
76
76
80
80
9
80

10
10
90
90
64
68
66
74a
74b
72a
72b
70b
70a
105
60
104
100c
80
80

64
82a
82b
154
154
60
150
152
156
156
72a
72b
80
80
80

FIG. 7
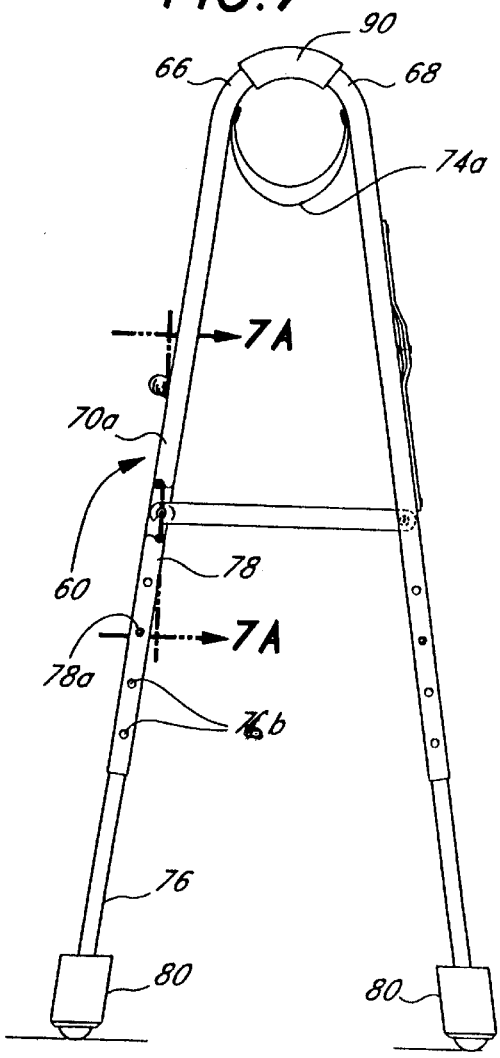
FIG. 8
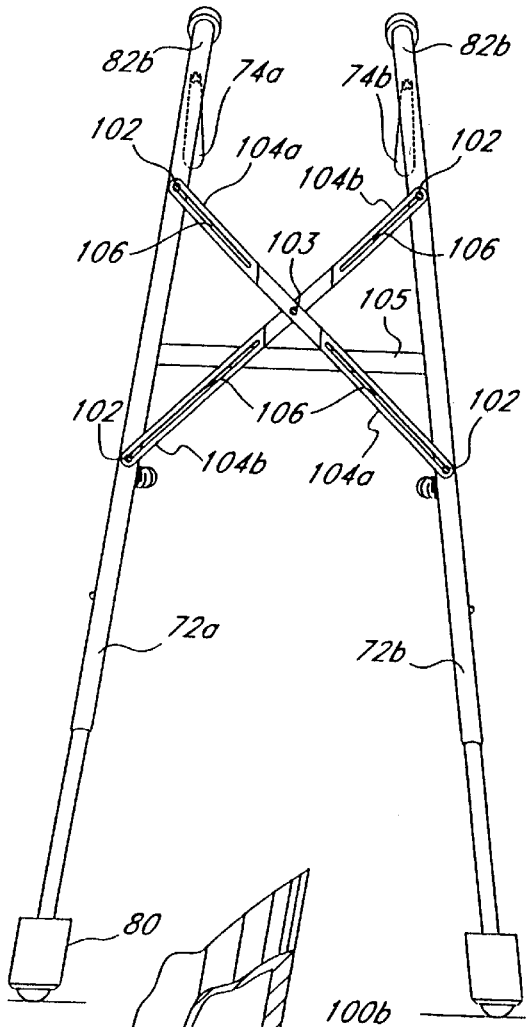
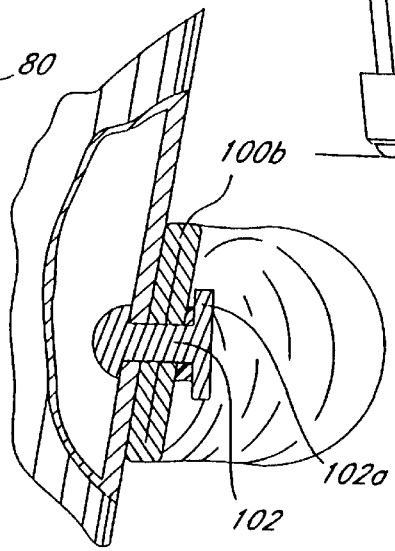
FIG. 7A 60
80
90
104
74a
104a
104b
100
96
82b
82a
70a
90a
105

SAFETY SUPPORT DEVICE WITH ADJUSTABLE ARM SUPPORT MEMBERS & METHOD

RELATED APPLICATIONS

This application is a continuation-in-part application of U.S. patent application Ser. No. 09/510,421, filed Feb. 22, 2000, entitled Safety Support Device & Method, which is a utility patent application based on U.S. provisional patent application Ser. No. 60/121,252, filed Feb. 23, 1999, entitled Skater Safety & Training Device & Method. These related patent applications are incorporated herein by reference and made a part of this application.

BACKGROUND OF THE INVENTION

There are many situations where an individual needs assistance standing erect. For example, roller skaters who are just leaning to skate, and injured or elderly people who need support when they walk.

In-line roller skates have become very popular, but they are much more difficult for novice skaters to master without falling frequently. Although helmets, knee pads, elbow pads and other safety accessories are used, they don't inhibit the skater from falling, but only provide protection if the skater falls. It would be very desirable for a novice skater to have some device which would prevent him or her from falling. Although such a device is especially useful for in-line roller skaters, those using conventional skates with two pairs of wheels straddling the center line of the skate could also benefit from such a device.

Injured and elderly people sometimes use walkers that are held in front of the user and moved forward in a stepwise manner as the person walks. These walkers usually have four support legs and a handle bar at about waist level of the user. They do not, however, support the entire weight of the user. Sometimes crutches are employed which are placed under the arm pits of the user and manipulated as the user walks. Each individual crutch only has one point of contact with the supporting floor. Crutches support the entire weight of the user, but they are sometimes difficult for some individuals to use. Consequently, it would be desirable to provide a safety support device that has the advantage of ease of use of a walker and also supports the entire weight of the user like a pair of crutches.

SUMMARY OF THE INVENTION

This invention has several features, no single one of which is solely responsible for its desirable attributes. Without limiting the scope of this invention as expressed by the claims that follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include, but are not limited to, improved safety for the user, compactness, portability, ease of manufacture, adjustability, and versatility.

The first feature of the safety support device of this invention is that it supports a user's body above ground while using the device. In a first embodiment, the device supports a user while seated, and in a second embodiment, the device supports the user in a standing erect position. The first embodiment is particularly suited for use by skaters. The second embodiment is used by injured and elderly individuals who need support while walking. Both embodiments have a frame including a mounting section from which four legs extend, a pair of forward legs and a pair of rear legs. Each embodiment has a roller assembly attached to a distal end of a leg. These roller assemblies each include a roller member mounted so that with the weight of the user bearing down on the assembly the roller member is prevented from moving. The roller member may be either a wheel or a ball.

The second feature is that the roller assembly may (1) move between an extended position when a user is using the device and not being supported by the device and a retracted position when a user is being supported by the device, or (2) includes a cover mounted to move along a shaft. The shaft has the roller member rotatably mounted to a distal end of the shaft with a proximal end of the shaft extending outward from the cover. The cover has an intermediate portion attached to a distal end of a leg, and the cover is mounted to slide along the shaft as the roller member moves between the extended and retracted positions. A spring interacts with the cover to normally urge the roller member and the cover away from each other so that the roller member is normally in the extended position.

The third feature is the unique construction of the frame of the first embodiment, the safety and training device. This frame preferably is made of metal tubes welded or otherwise attached together. It comprises a pair of attached tubular members, each tubular member being bent in essentially an identical fashion in a curved, substantially M-shaped configuration. Portions of the tubular members form the forward legs and rear legs. These legs preferably outwardly diverge and have a length of from about 28 to about 36 inches and are arranged so that the mounting section is substantially parallel to ground. The mounting section is from about 28 to about 36 inches above ground. In this first embodiment, the length of the mounting section is from about 12 to about 18 inches, and it has a central, depressed segment across which the seat extends. Also, there is a handle member, preferably in the form of a loop, mounted to the forward end of the mounting section in advance of the seat.

The forth feature is the unique construction of the frame of the second embodiment, the walker support device. In this second embodiment, the mounting section includes a pair of under arm support members attached to the mounting section. Each arm support member engages an arm pit of the user when the user is being supported by the device, and the legs are of a length that enables the user to assume a standing position with the support members beneath the arm pits of the user's arms and user's feet touching the ground. The legs have an adjustable length of from about 48 to about 72 inches to accommodate the height of the user. There are hand grips extending between adjacent forward and rear legs, and the mounting section includes a pair of sleeve members, with adjacent proximal ends of the forward and rear legs extending into an individual sleeve member. The under arm support members are flexible, the hand grips are mounted to be repositioned, and legs are foldable inward to provide a compact structure. Preferably, this second embodiment includes a harness.

A third embodiment used by injured and elderly individuals who need support while walking includes is a manually release mechanism associated with each under arm support member. The release mechanism enables the user, while standing erect, to change the position of the under arm support members to accommodate the height of the individual user. Each release mechanism includes a stop member that is manually moveable between two positions: a first position engaging an associated under arm support member and holding this associated under arm support member in one of a plurality of different positions and a second position allowing the associated under arm support member to be repositioned. Preferably, each release mechanism includes a flexible, resilient handle that is connected to the stop member. The handle is manually manipulated to move the stop member between the first and second positions. The stop member is mounted on a spring element that is loaded upon manual manipulation of the handle and returns to its unloaded condition upon disengaging the handle.

DESCRIPTION OF THE DRAWING

The preferred embodiments of this invention, illustrating all its features, will now be discussed in detail. These embodiments depict the novel and non-obvious safety support devices and method of this invention as shown in the accompanying drawing, which is for illustrative purposes only. This drawing includes the following figures (FIGS.), with like numerals indicating like parts:

FIGS. 1 through 5 illustrate the first embodiment of this invention wherein:

FIG. 1 is a perspective view of the skater safety and training device of this invention.

FIG. 2 is a fragmentary perspective view of the skater safety and training device of this invention, looking from the user's point of view when mounted on the device.

FIG. 4 is a side view of the skater safety and training device of this invention showing a user using the device while skating.

FIG. 5 is a side view similar to that of FIG. 4 showing how the device prevents a user from falling, with the wheels in the retracted position and the device supporting the user in a seated position.

FIGS. 6 through 17 illustrate the second embodiment of this invention wherein:

FIG. 6 is a perspective view of the walker support device of this invention in an unfolded state.

FIG. 6C is a perspective view of the harness attached to the walker support device depicted in FIG. 6 and shown phantom lines.

FIG. 7 is a side elevational view of the walker support device shown in FIG. 6 taken along line 7—7.

FIG. 7A is a cross-sectional view taken along line 7A—7A of FIG. 7.

FIG. 8 is a rear elevational view of the walker support device shown in FIG. 6 taken along line 8—8.

FIG. 9 is an enlarged, fragmentary, exploded perspective view of the roller assembly taken along line 9 of FIG. 6, showing a ball employing a brake.

FIG. 10 is a plan view taken along line 10—10 of FIG. 6 depicting the user moving to straight ahead.

FIG. 11 is a plan view similar to that shown in FIG. 10 depicting the user moving to the left as shown in this view.

FIG. 12 is a plan view similar to that shown in FIG. 10 depicting the user moving to the right as shown in this view.

FIG. 13 is a plan view similar to that shown in FIG. 10 depicting the user moving to the rear.

FIG. 14 is a side view of the device illustrated in FIG. 6 showing the front brace and side hand grips folded up and the distal ends of the legs pushed into the interior of the upper legs.

FIG. 15 is a side view of the device illustrated in FIG. 14 showing the front and rear legs detached.

FIG. 16 is a rear view showing the cross-bars being pushed inward to bring the two pairs of legs together as depicted in FIG. 17.

FIG. 17 shows the device illustrated in FIG. 6 in the folded state.

FIGS. 18 through 25 illustrate the third embodiment of this invention wherein:

FIG. 18 is a perspective view of the third embodiment of the safety support device of this invention that includes adjustable arm support members.

FIG. 19 is an exploded view of the safety support device shown in FIG. 18 with a section broken away to show one of the spring elements used in connection with the arm support members.

FIG. 20 is a fragmentary side elevational view encircled by line 20 of FIG. 18 showing the release mechanism used in connection with the safety support device of this invention.

FIG. 21 is a perspective view of the release mechanism shown in FIG. 20.

FIG. 22 is a perspective view of an L-shaped metal mounting element for the stop member.

FIG. 23 is a side elevational view of the embodiment shown in FIG. 18.

FIG. 24 is a side elevational view similar to that shown in FIG. 23 with the adjustable arm support moved to its lower position and one of the legs moved upward into a vertical support tube.

FIG. 25 is a perspective view of one side of an alternate embodiment of this invention employing a caster instead of a stationary foot member.

DETAILED DESCRIPTION OF THE PREFERRED EMBODIMENTS

Skater Safety Training Device

Figure 1:
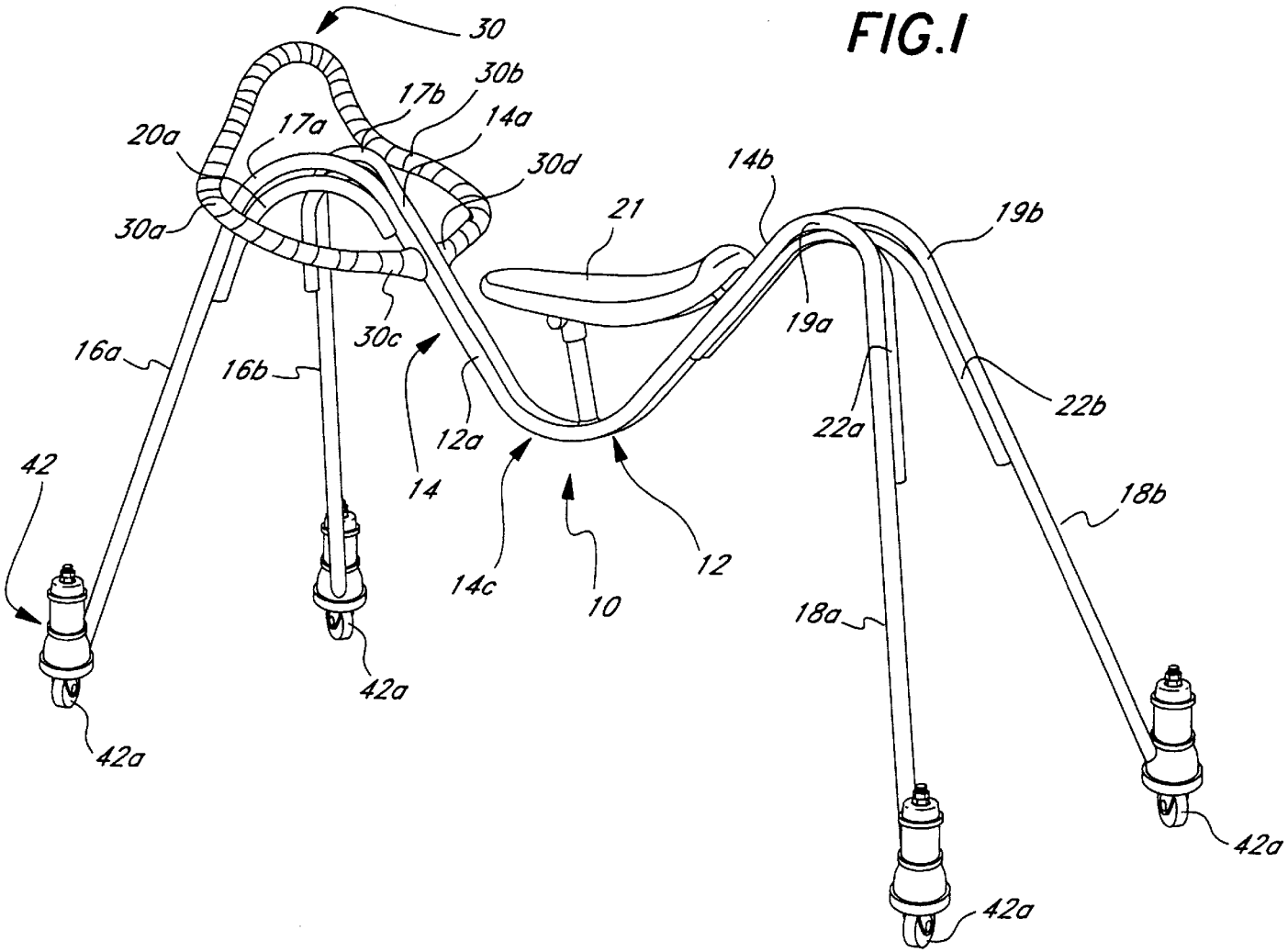
Figure 4:
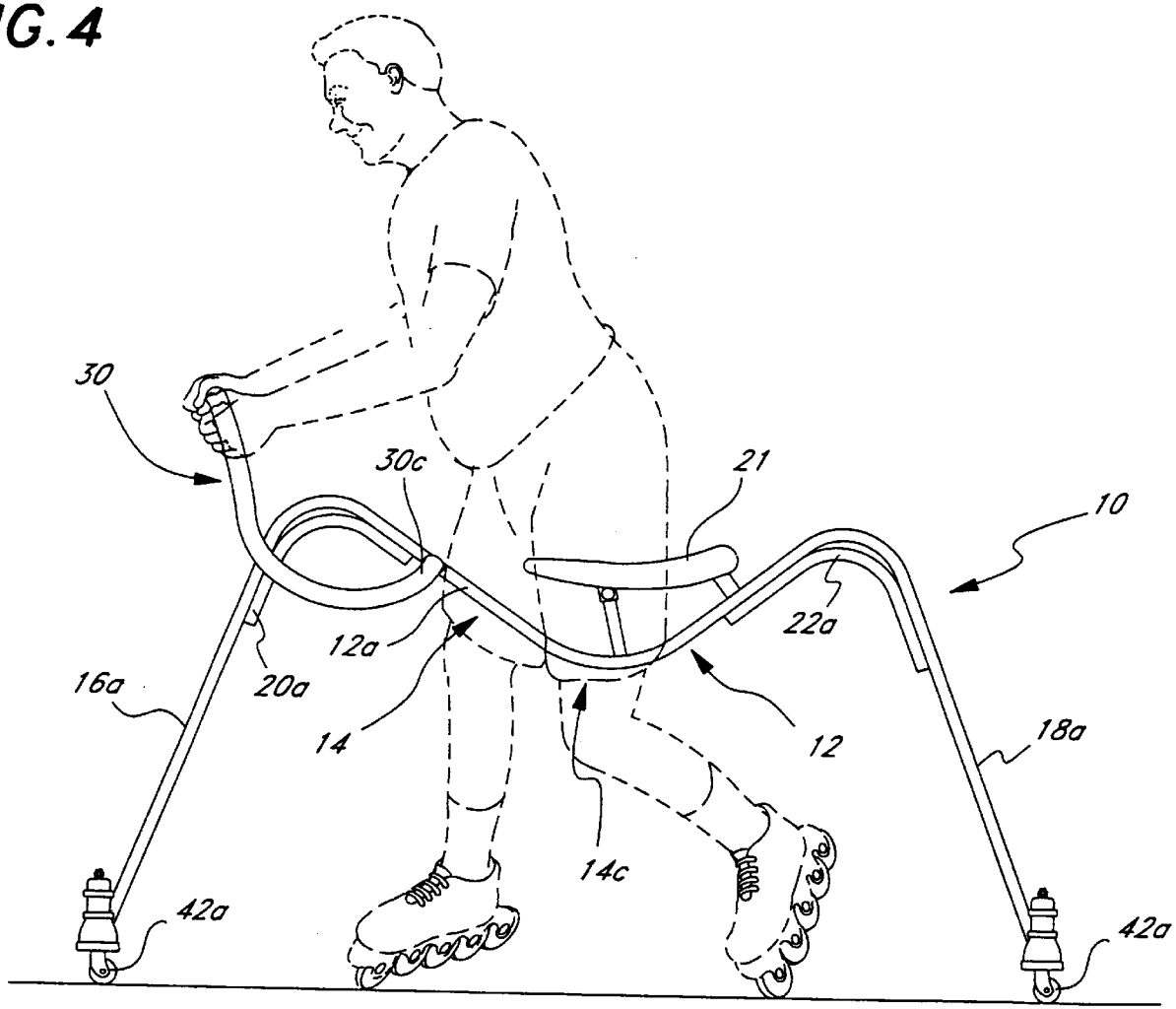
Figure 5:
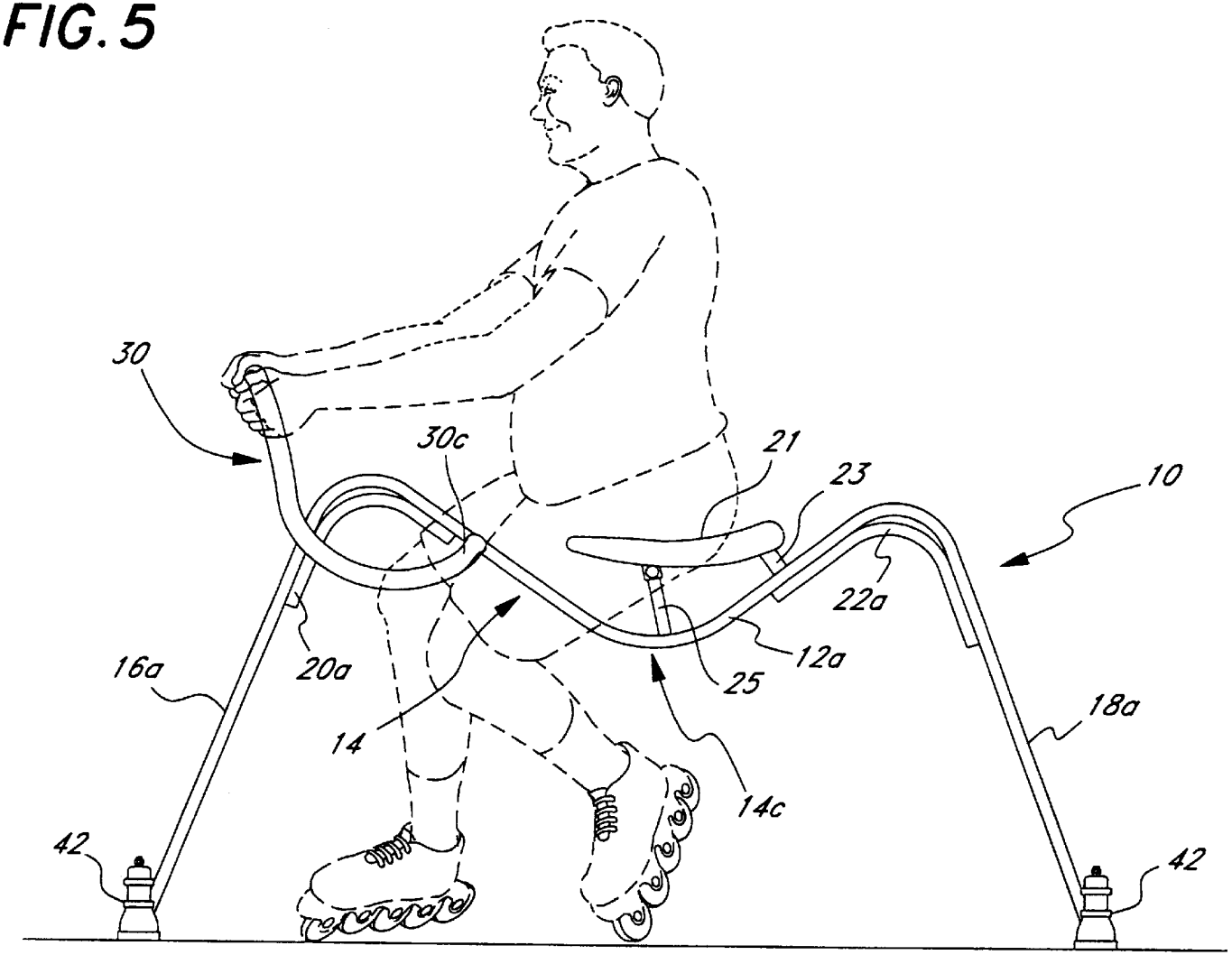

As best shown in FIG. 1, the skater safety and training device 10 of this invention is used by a skater (shown in phantom) who straddles the device while skating, as shown in FIG. 4. The device 10 includes a frame 12 adapted to catch the skater when he or she falls and support the skater in a seated position as shown in FIG. 5.

The frame 12 is made of a metal such as steel or aluminum, preferably of a tubular construction. It comprises a pair of metal tubes 12*a* and 12*b*, each bent in essentially an identical fashion in a curved, substantially M-shaped configuration. The tubes 12*a* and 12*b* are placed in registration and welded or otherwise fixedly connected to each other to form a mounting section 14 having a forward end 14*a* and a rear end 14*b*. The outside diameter of the tubes 12*a* and 12*b* making up the frame 12 is from about 1 to about 1.25 inch. The length of the mounting section 14 is from about 12 to about 18 inches. A central, depressed segment 14*c* of the mounting section 14 has a seat 21 extending across this segment. A pair of tubular supports 23 and 25 extend upward from the mounting section 14 and are connected to the underside of the seat 21. The seat 21 is slightly lower than the forward end 14*a* and rear end 14*b* of the mounting section 14.

A pair of outwardly diverging, forward legs 16*a* and 16*b* extend from the forward end 14*a* downward toward the ground and a pair of outwardly diverging, rear legs 18*a* and 18*b* extend from the rear end 14*b* downward toward the ground. Each pair of legs 16*a*, 16*b* and 18*a*, 18*b* form an inverted V-shaped configuration and are integral, respectively, with the tubes 12*a* and 12*b*. Each leg 16*a*, 16*b* and 18*a*, 18*b* is about the same length, typically having a length of from about 28 to about 36 inches. A pair of reinforcing arcuate members 20*a* and 20*b* are connected across upper portions 17*a* and 17*b*, respectively, of each forward leg 16*a* and 16*b* and the forward end 14*a* of the mounting section 14 to the tubes 12*a* and 12*b*, respectively. Another pair of reinforcing arcuate members 22*a* and 22*b* are connected across upper portions 19*a* and 19*b*, respectively, of each rear leg 18*a* and 18*b* and the rear end 14*b* of the mounting section 14 to the tubes 12*a* and 12*b*, respectively. The upper portions 17*a*, 17*b*, 19*a* and 19*b* form the proximal ends of the legs 16*a*, 16*b*, 18*a*, 18*b*, respectively, and are above the central segment 14*c* of the mounting section 14.

Figure 2:
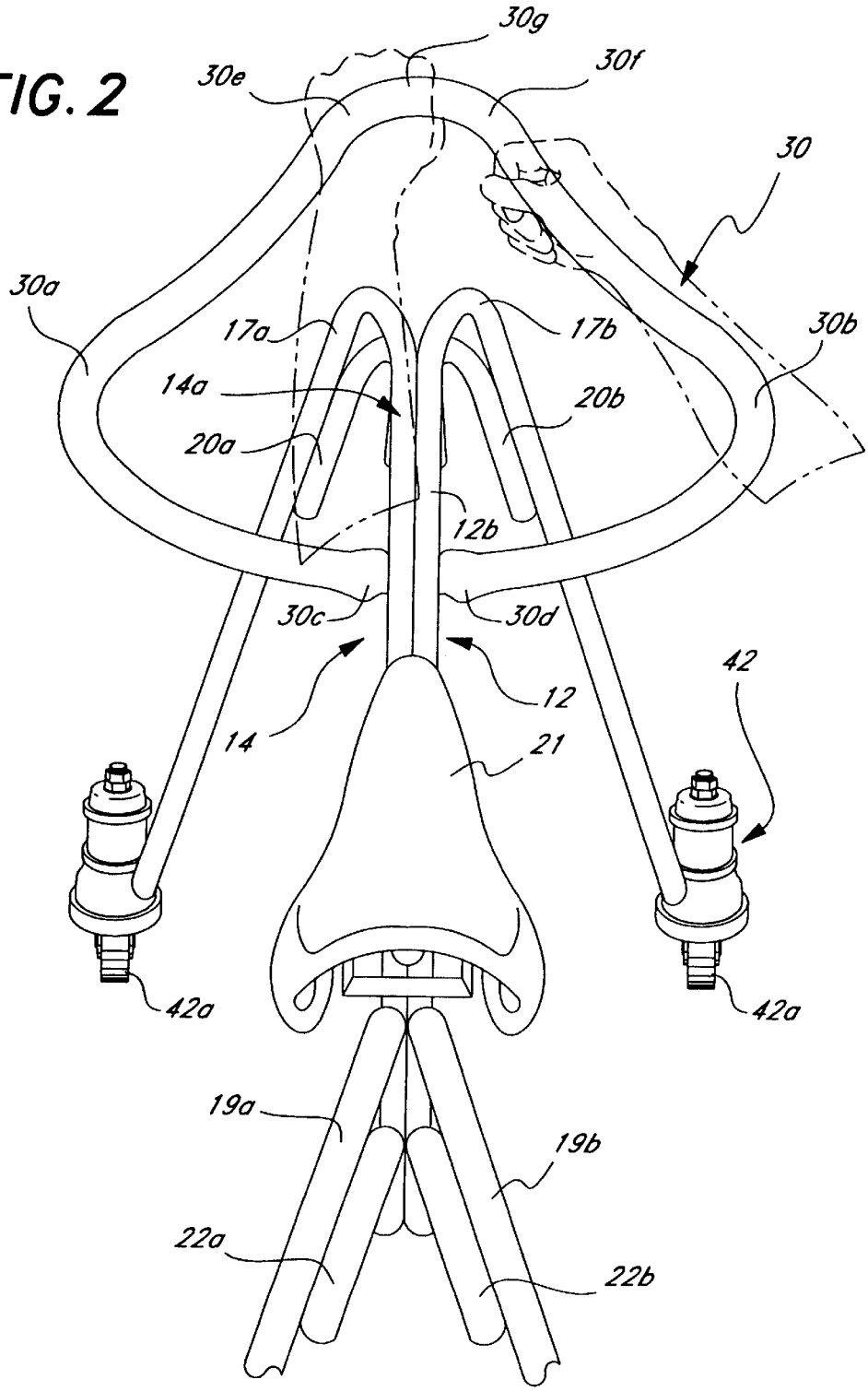

As best shown in FIG. 2, there is a handle member 30 in the form of a loop attached to the forward end 14*a* of the mounting section 14. The looped handle 30 has a substantially triangular configuration with opposed sides 30*a* and 30*b*, each having rear ends 30*c* and 30*d*, respectively, welded or otherwise fixedly connected to the tubes 12*a* and 12*b*. The forward ends 30*e* and 30*f* of the handle 30 join to form the apex 30*g* of the triangular shaped looped handle 30. These forward ends 30*e* and 30*f* form a forward section which is tilted upward and the rear ends 30*c* and 30*d* form a rear section which is tilted downward. The skater may conveniently grasp either the forward or rear sections of the handle while skating. In FIG. 4, the skater is shown grasping the forward, upwardly titled section of the handle 30.

Figure 3A:
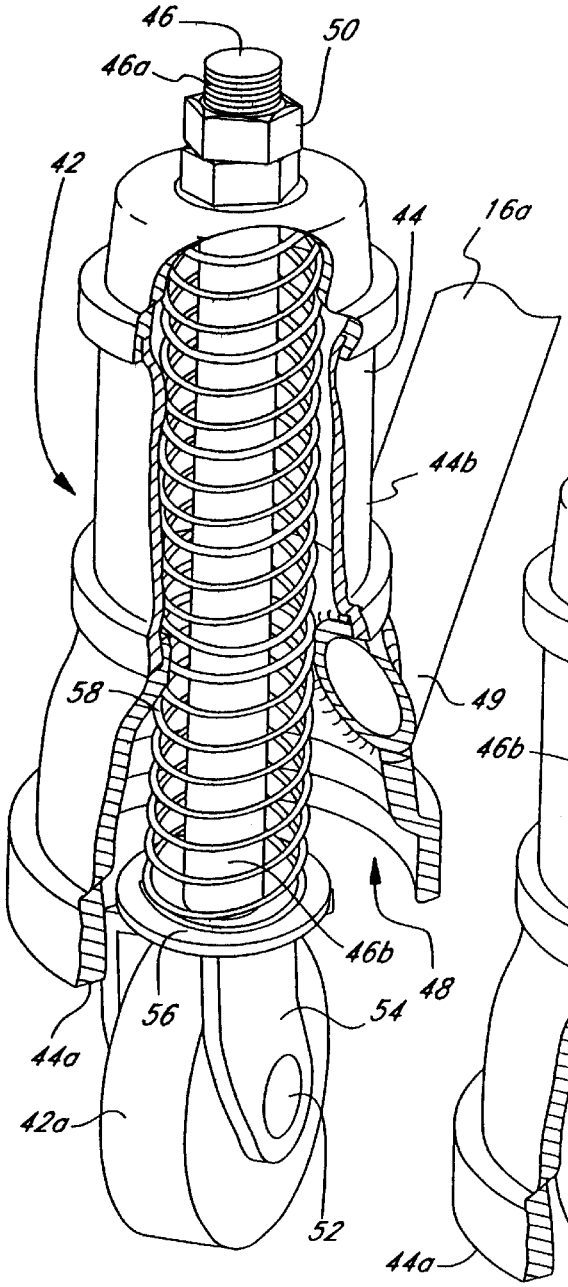
FIG. 3A is a fragmentary perspective view of one of the wheels and cover therefor with the wheel in the extended position.
Figure 3B:
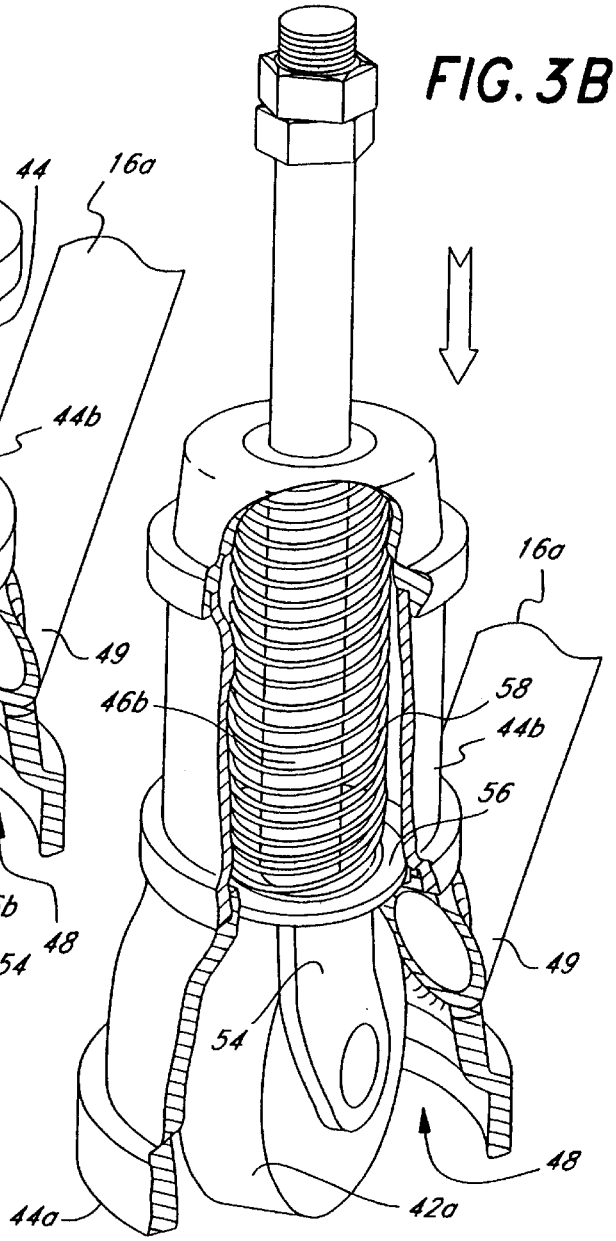
FIG. 3B is a fragmentary perspective view similar to that of FIG. 3A showing one of the wheels and cover therefor with the wheel in the retracted position.

As best shown in FIGS. 3A and 3B, each leg 16*a*, 16*b*, 18*a*, 18*b* has a distal end 49 to which is attached a wheel assembly 42. Each wheel assembly 42 includes a wheel 42*a* mounted to move between extended and retracted positions. The extended position is shown in FIGS. 3A and 4 where the skater is straddling the device 10 and skating in a normal fashion and not being supported by the seat 21. The retracted position is shown in FIGS. 3B and 5 where the skater has fallen and has been caught by the device 10 and is being supported by the seat 21.

Each wheel assembly 42 includes a cover 44 which covers each wheel 42*a* and a central, longitudinal shaft 46 extends from the top of the cover into the hollow, interior 48 of the cover and having an intermediate portion 44*b* welded or otherwise attached to the distal end 49 of a leg, in this case the leg 16*a*. This shaft 46 has a treaded outer end 46*a* with nuts 50 secured to this outer end to act as a stop to prevent the cover 44 from sliding off the end 46*a* of the shaft 46. As best shown in FIGS. 3A and 3B, each wheel 42 is rotatably mounted to an axle 52 which is carried by a yoke 54 that has a land 56 at its upper portion. The inner end 46*b* of the shaft 46 is welded or otherwise secured to the land 56, and the cover 44 slides along the shaft as the wheel 42*a* moves between the extended and retracted positions. A strong, coiled spring 58 wrapped around the shaft 46, having one end bearing against the land 56 and its opposite end bearing against the inside top of the cover 44, normally urges the yoke 54 outward and the cover upward, so that the wheel 42*a* is normally in the extended position. With entire the weight of the skater on the seat 21 and supported by the device 10, the cover 44 slides downward towards the ground along the shaft 46, compressing the spring 58 as shown in FIG. 3B, and the wheel 42*a* is moved into the retracted position within the cover 44 as shown in FIGS. 3B and 5. As shown as the weight of the skater is removed, the spring 58 pushes the cover 44 upward along the shaft 46, exposing the wheel 42*a*.

To use the device 10 of this invention, the skater simply straddles the device along the mounting section 14 with each leg of the skater on one side of the device and his or her crotch above but not touching the seat 21. The skater grasps the handle 30, preferably with both hands, and begins to skate in a normal fashion. As shown in FIG. 5, if the skater looses his or her balance and begins to fall, they simply sit on the seat 21 and the wheels 42*a* are retracted into the cover 44, with the bottom edge 44*a* resting on the ground. The device 10 supports the skater in this seated position and prevents him or her from falling and injuring themselves.

Walker Support Device

Figure 6:
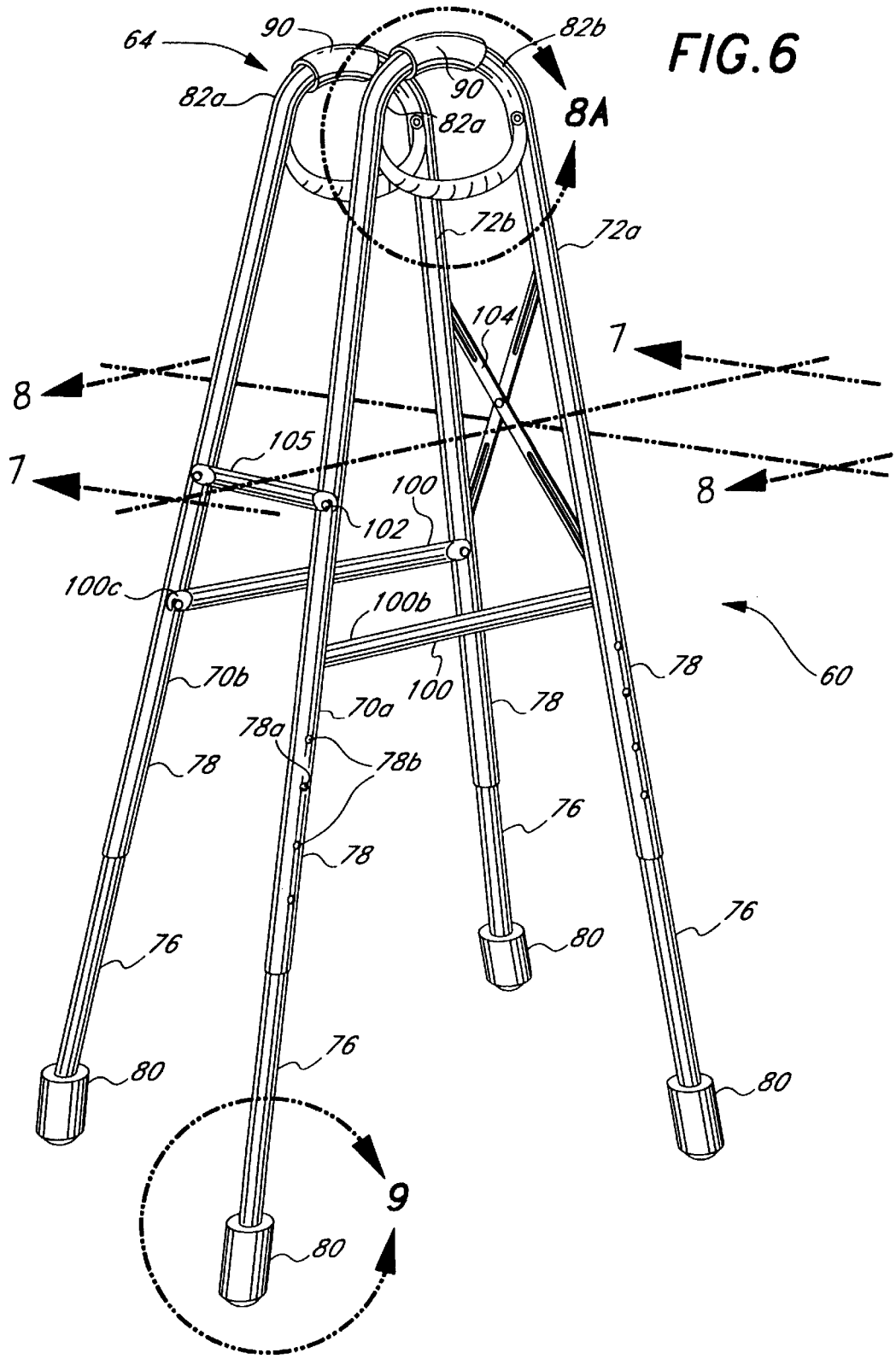
Figure 6A:
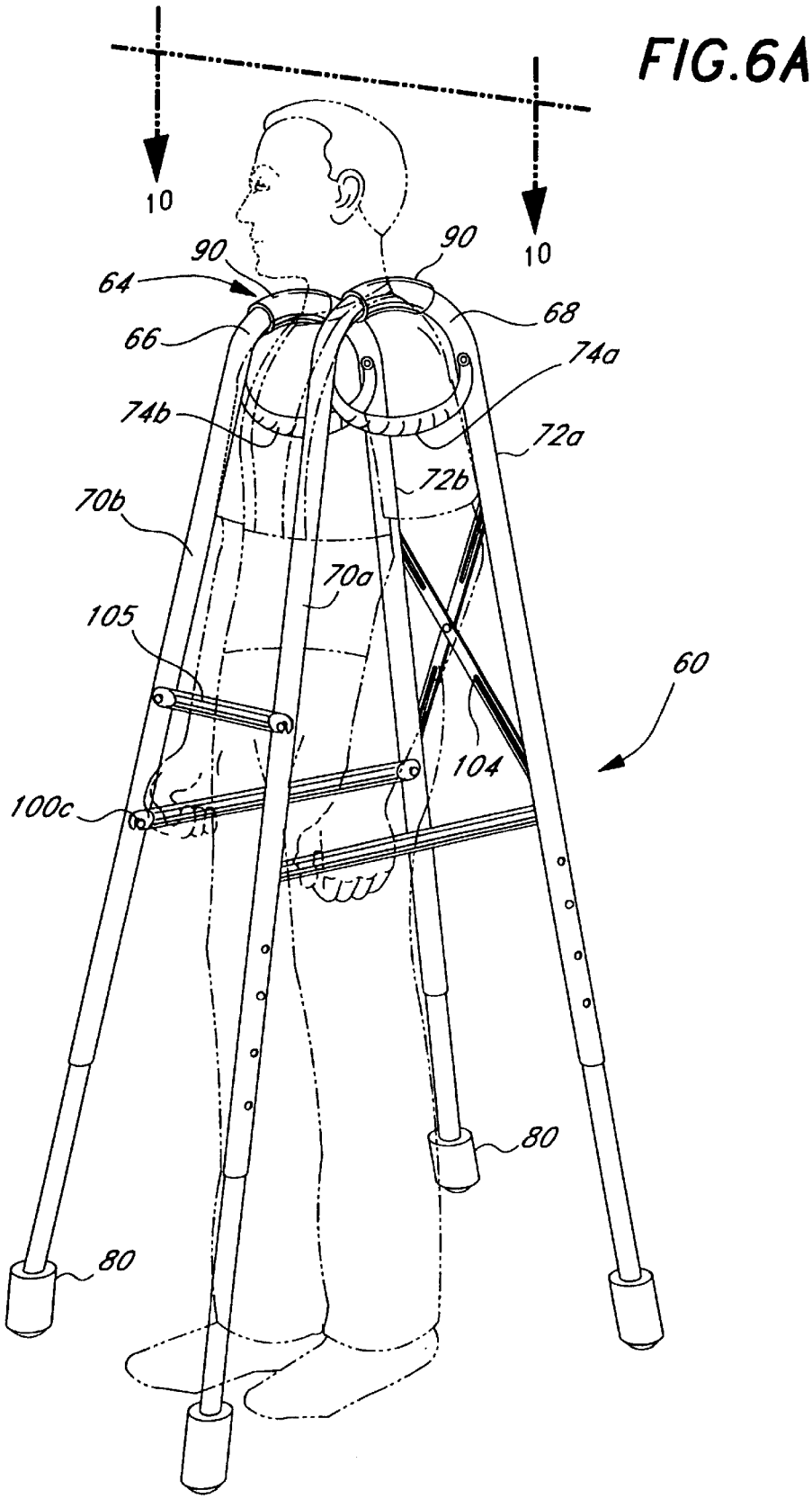
FIG. 6A is a perspective view of the walker support device depicted in FIG. 6 illustrating a user in phantom lines standing erect using the device.
Figures 8A, 8B, 8C, 8D:
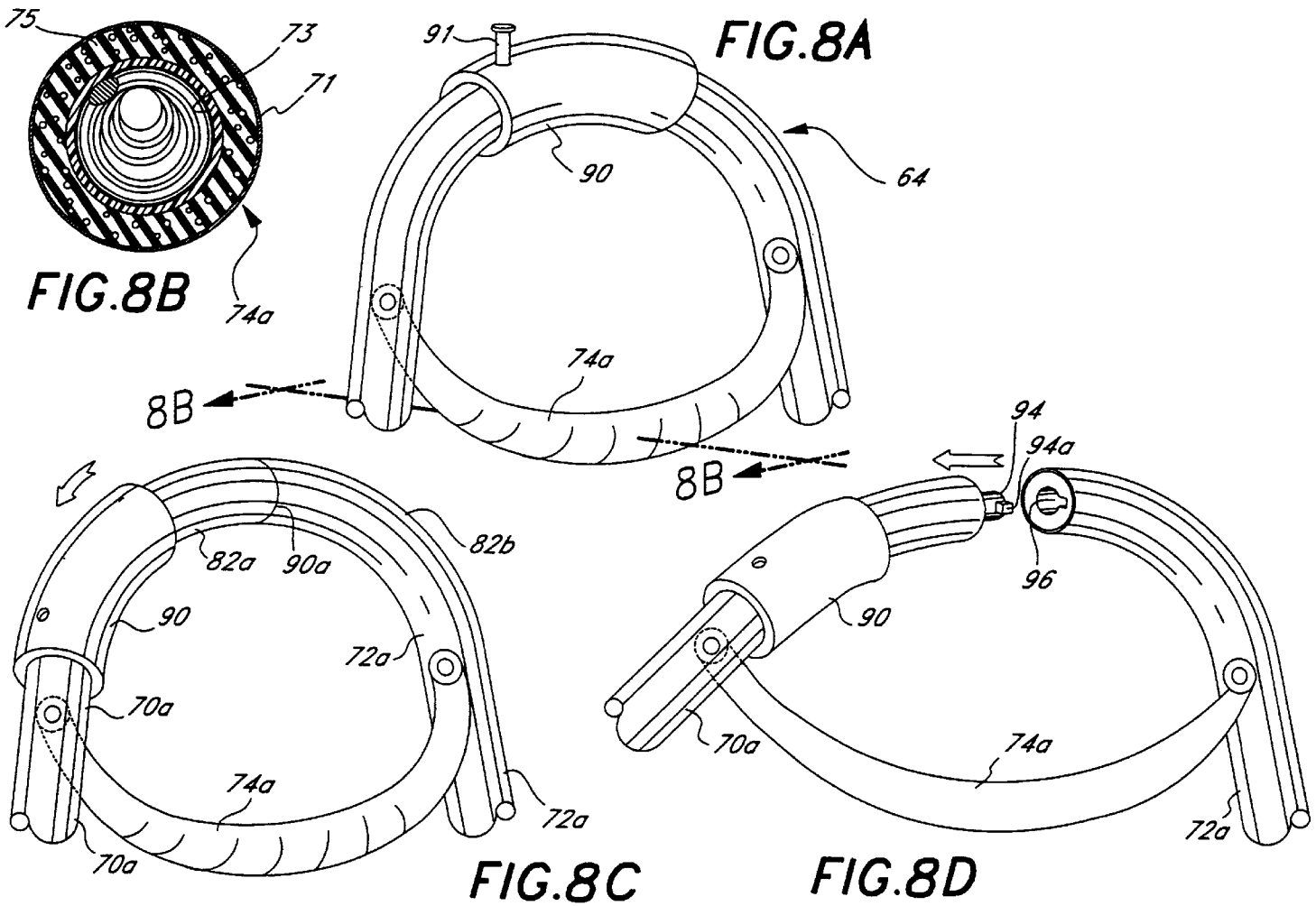
FIG. 8A is an enlarged, fragmentary perspective view of the mounting section.
FIG. 8B is a cross-sectional view taken along line 8B-8B of FIG. 8A.
FIG. 8C is an enlarged, fragmentary perspective view of the mounting section showing the sleeve moved to allow disconnection of the upper segments of a pair of front and rear legs.
FIG. 8D is an enlarged, fragmentary perspective view of the mounting section showing a pair of front and rear legs disconnected.

The second embodiment of this invention, the walker support device 60, is used to support a user's body above ground while the user is in an erect standing position as depicted in FIG. 6A. It includes a frame 62 having a mounting section 64 with a forward end 66 and a rear end 68. There are a pair of forward legs 70*a* and 70*b* integral with the forward end 66 of the mounting section 64 and a pair of rear legs 72*a* and 72*b* integral with the rear end 68 of the mounting section. A pair of flexible under arm support members 74*a* and 74*b* are attached beneath the mounting section 64. As best shown in FIG. 6A, each arm support member 74*a* and 74*b* forms a loop that engages an arm pit of the user when the user is being supported by the device 60. As shown in FIG. 8B, each of these each arm support member 74*a* and 74*b* comprises a pair of concentric tubular members 71 and 73 separated by a foam material 75.

There are hand grips 100 extending between adjacent pairs of forward and rear legs 70*a*, 72*a* and 70*b*, 72*b*. These hand grips 100 each have one end 100*a* pivotally connected to a rear leg 72*a* and 72*b*. As best shown in FIG. 7A, another end 100*b* with a notch 100*c* in it engages a rod 102 with a flat end 102*a* extending outward from each of the forward legs 70*a* and 70*b* when the device 60 is in the unfolded state. A front brace 105, constructed like the hand grips, extends between the front legs 70*a* and 70*b*. It has one end pivotally mounted to the leg 70*b* and its other end engaging a rod extending from the other leg 70*a*. A cross-bar 104 is attached to the rear legs 72*a* and 72*b*. As best depicted in FIG. 8, it comprises two braces 104*a* and 104*b* positioned in an X shape. These braces 104*a* and 104*b* have their centers attached to pivot pin 103 and their ends mounted to side along the rear legs 72*a* and 72*b*. There is a pair of open channels 106 in each brace 104*a* and 104*b* on opposite sides of the pivot pin 103 that allow fixed rods 102 in the legs 72*a* and 72*b* to slide in these open channels upon folding the cross-bar 104 as shown in FIGS. 16 and 17.

The legs 70*a*, 70*b*, 72*a*, and 72*b* are of a length that enables the user to assume a standing position with the support members 74*a* and 74*b* beneath the arm pits of the user's arms and user's feet touching the ground. These legs 70*a*, 70*b*, 72*a*, and 72*b* are adjustable so their length accommodates the height of the user. Each leg 70*a*, 70*b*, 72*a*, and 72*b* has a distal segment 76 that slides telescopically into an upper segment 78. In the upper segment 78 there are a series of holes 78*a* and in the distal segment there is a spring loaded pin 76*a*. When the pin 76*a* is aligned with a hole, it snaps into a hole and remains there until manually depressed. With the pin 76*a* depressed, the distal segment 76 may be repositioned, for example, pushed completely into the upper segment 78 for storage when the device 60 is being moved into its folded state as shown in FIGS. 14 through 17. The length of the legs 70*a*, 70*b*, 72*a*, and 72*b* are adjusted manually by positioning the pin 76*a* in the appropriate holes 78*a* so that all the legs are of equal length.

Figure 9:
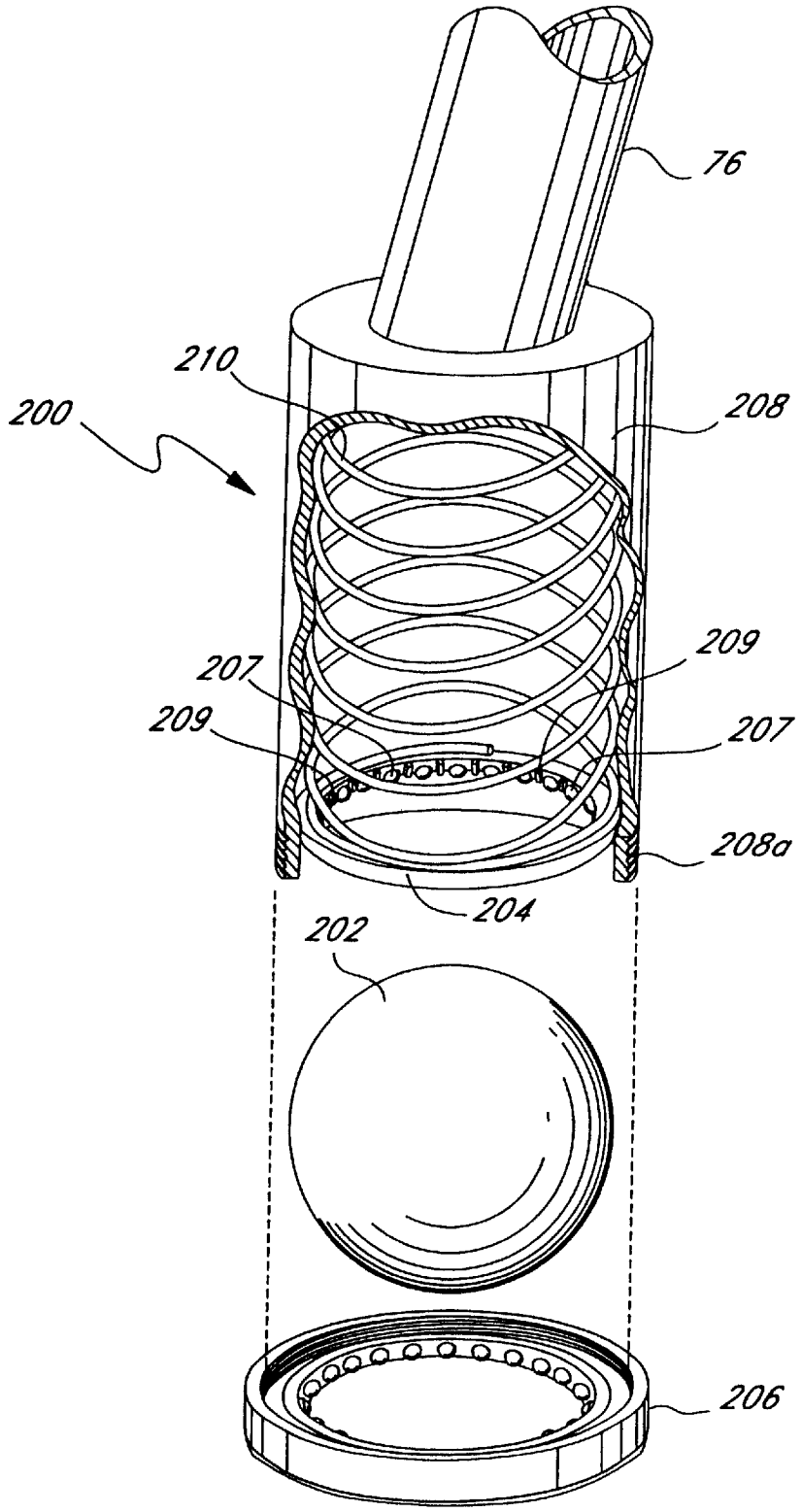
Figure 10:
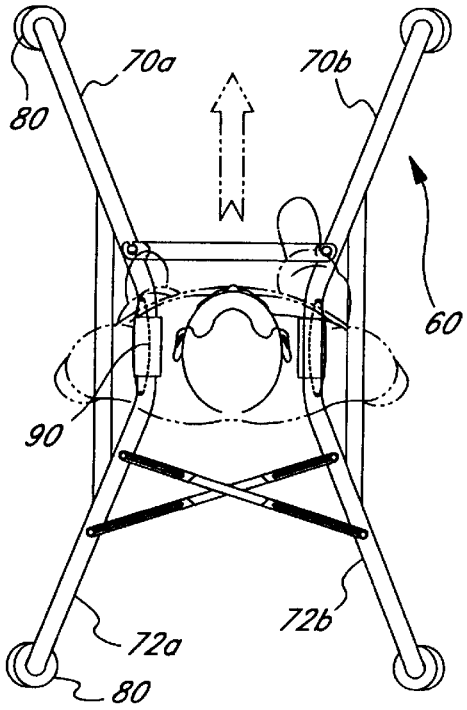
Figure 11:
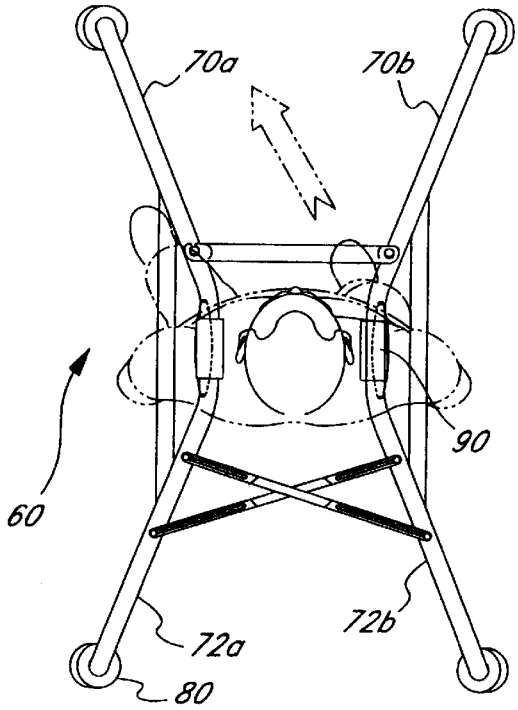
Figure 12:
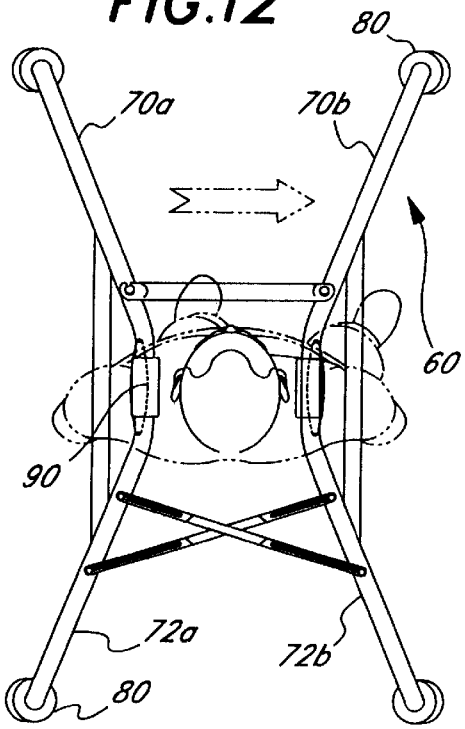
Figure 13:
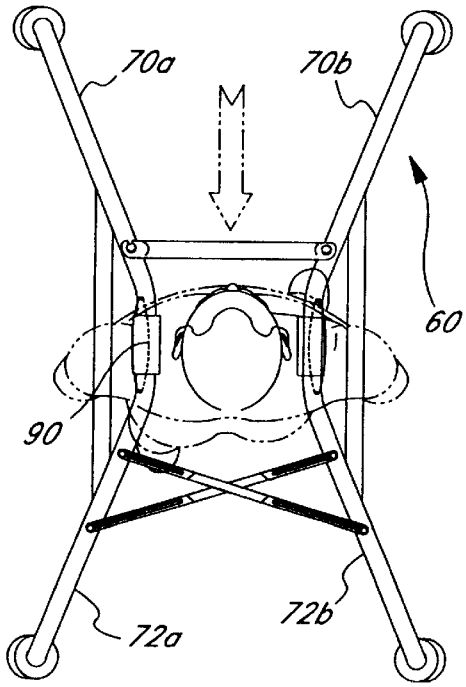

Each leg 70*a*, 70*b*, 72*a*, and 72*b* has a distal end to which is attached a ball roller assembly 200. As best shown in FIG. 9, each ball roller assembly 200 includes a ball 202 mounted between a moveable bearing race 204 and a stationary bearing race 206. The moveable bearing race 204 has disposed between individual roller bearing 207 nylon brake pads 209. The roller assemblies 200 each include a cover 208 that houses a compression spring 210 that is attached to the moveable bearing race 204. The stationary bearing race 206 is attached to the treaded end 208*a* of the cover 208. When the spring 210 is not in compression, the nylon brake pads 209 are adjacent to the surface of the ball 202 or just touch this surface. Consequently, the ball 202 is free to rotate as long as the weight of the user does not bear down on the device 60. When the device 60 is supporting the entire weight of the user, the nylon brake pads 209 engage the surface of the ball 202, inhibiting rotation of the ball. When device 60 is not supporting the entire weight of the user, the spring 210 pulls the moveable bearing race 204 inward to disengage the nylon brake pads 209. The ball roller assembly 200 is shown used in connection with the device 60, but it could also be used with the skater safety and training device 10.

Figures 14, 15, 16, 17:
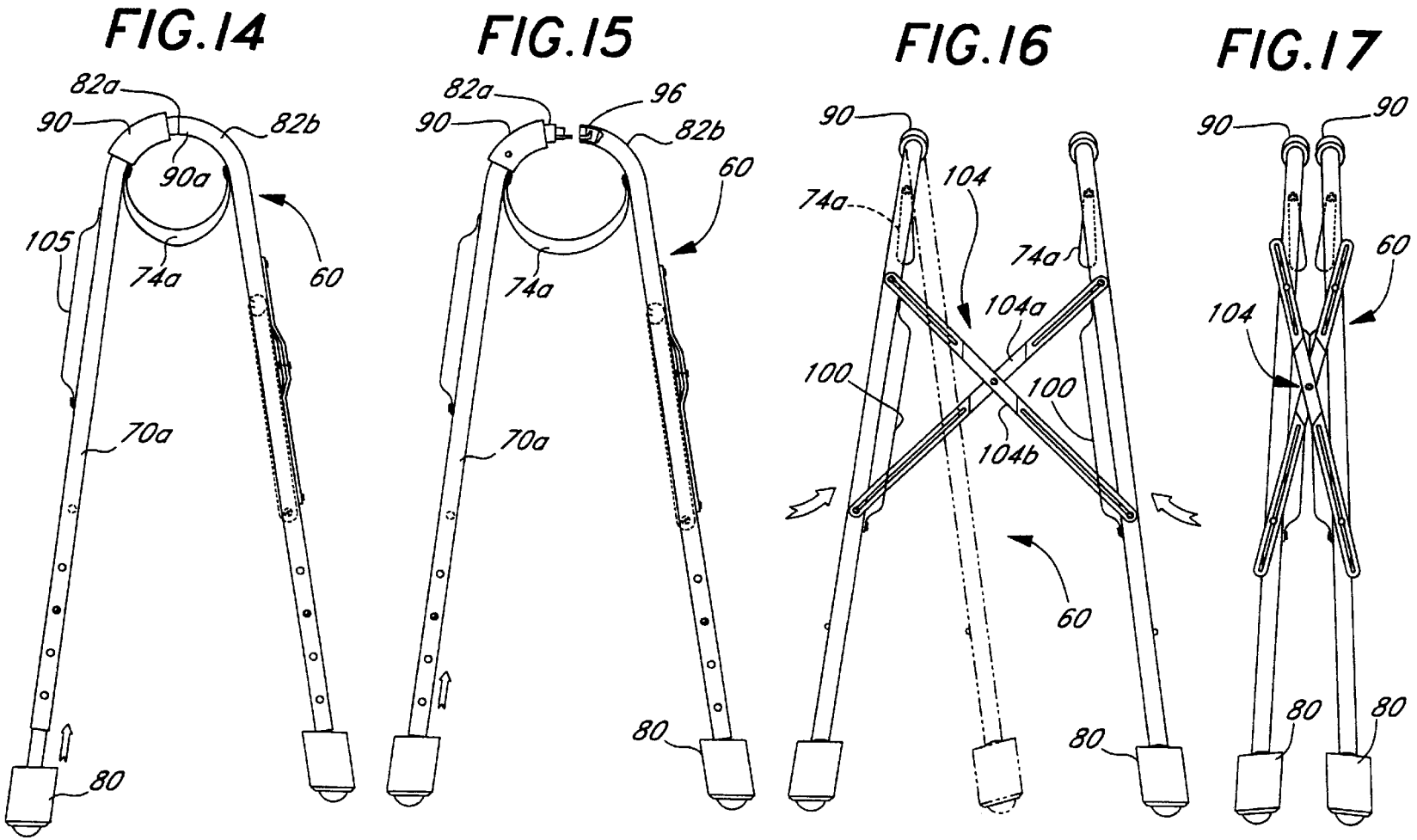

The upper segments 78 of the legs 70*a*, 70*b*, 72*a*, and 72*b* are curved so that the curved portions 82*a* and 82*b* of each aligned pair of forward legs and rear legs 70*a*, 72*a* and 70*b*, 72*b* face each other as best shown in FIGS. 6, 8A through 8D, 14, and 15. These curved portions form the mounting section 64, and the legs 70*a*, 70*b*, 72*a*, and 72*b* are all of tubular construction. A moveable sleeve 90 covers these curved portions 82*a* and 82*b* when the device 60 is in the unfolded state as depicted in FIGS. 6 and 8A. As shown in FIG. 8A, the sleeve 90 normally is in a central position that overlies the junction 90*a* between the abutting ends of the curved portions 82*a* and 82*b*. A pin 91 holds the sleeve 90 in position overlying the junction 90*a* until manually pulled from the sleeve to allow the sleeve to be moved sideways. As shown in FIGS. 8C and 14, the junction 90*a* is exposed when the sleeve 90 is moved sideways from its central position to expose the opposed and abutting proximal ends of the curved portions 82*a* and 82*b*. As shown in FIG. 8D, these opposed ends of the curved portions 82*a* and 82*b* are connected by a tongue 94 in the one end that fits into a groove 96 in the other end. To disconnect the opposed ends of the curved portions 82*a* and 82*b* the sleeve 90 is simply moved sideways and one leg 70*a* rotated to disengage a locking element 94*a* at the end of the tongue 94. The opposed ends are then pulled apart to pull the tongue 94 from the groove 96. In an alternate arrangement, the legs may be coupled together so that merely twisting the legs relative to each other enable a connecting element to act as a hinge, permitting the legs to simply be folded inward towards each other. Reposition in the legs will cause them to be locked together.

Figure 6B:
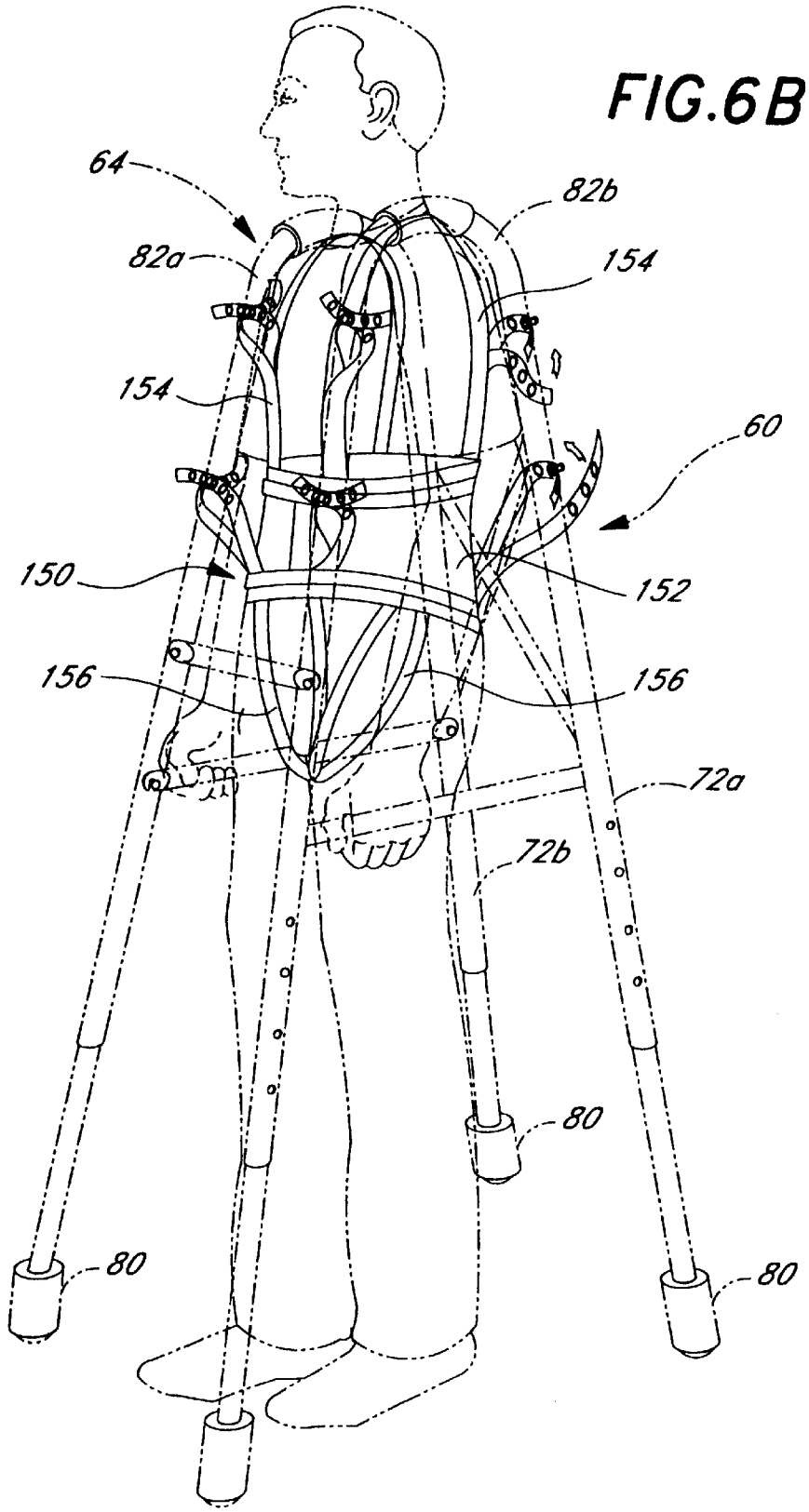
FIG. 6B is a perspective view of the walker support device depicted in FIG. 6 and shown in phantom lines showing a user in phantom lines standing erect and being strapped to the device by a harness.
Figure 6D:
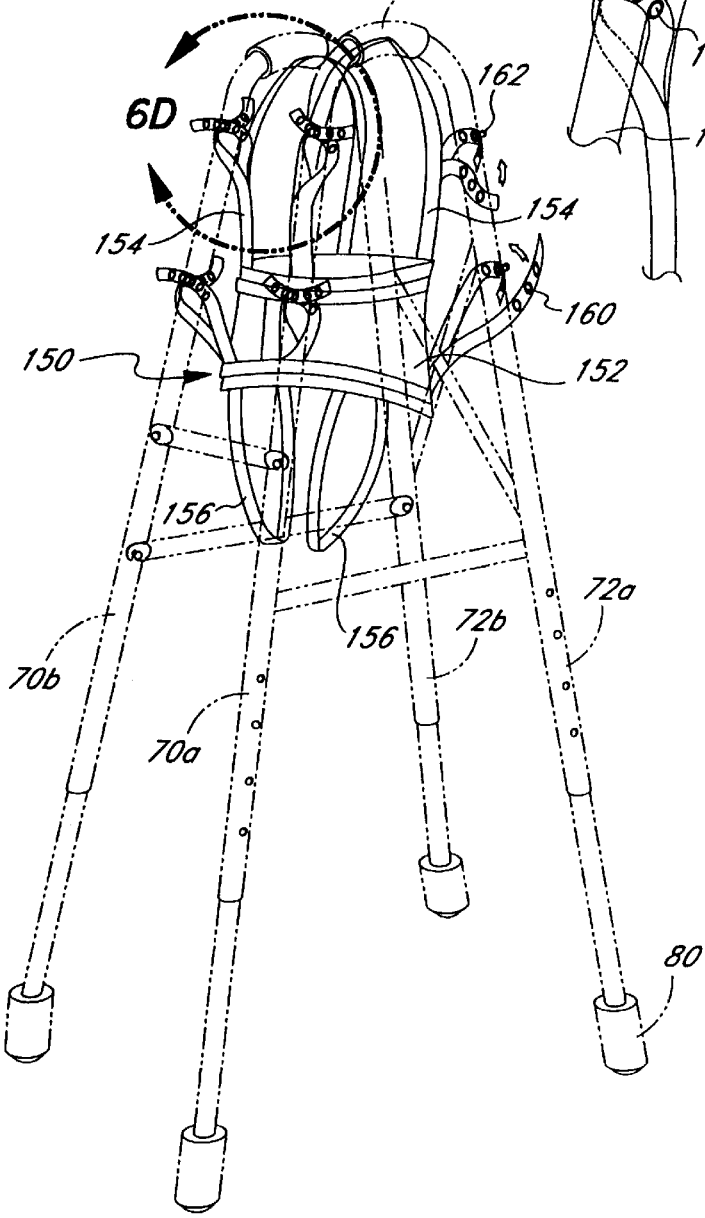
FIG. 6D is an enlarged, fragmentary perspective view taken along line 6D of FIG. 6C illustrating the manner of attaching the harness to the device.
Figure 6D:
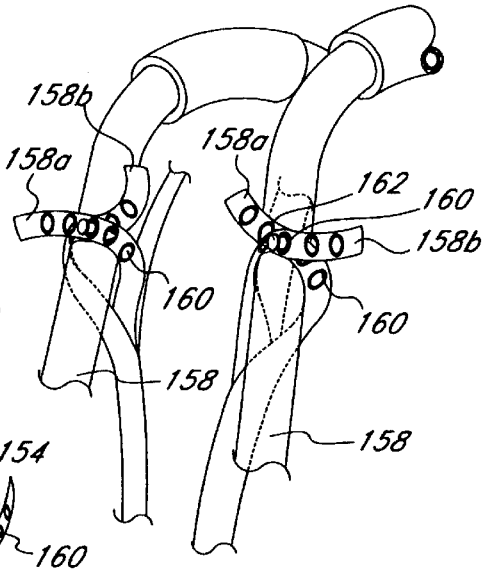

As illustrated in FIGS. 6B, 6C And 6D, the device may optionally include a harness 150. This harness 150 has a waist band 152 with shoulder straps 154 extending upward from the waist band 152 and leg straps 156 extending downward from the waist band. The lower portions of the leg straps 156 are joined together. Extending form each of the shoulder straps 154 and each of the legs straps 156 is a connector strap 158. Each connector strap 158 has two sections 158*a* and 158*b* with a series of eye opening 160 therein. Fingers 162 extending outward from the upper segment 78 of the legs 70*a*, 70*b*, 72*a*, and 72*b* fit through two overlapping sections 158*a* and 158*b*. The manner of attaching the harness to the device 60 is best illustrated in FIG. 6D. One section 158*a* is wrapped in one direction around a portion of the leg adjacent a finger 162 and the finger 162 is slipped into an eye opening 160 in section 158*a*. The other section 158*b* is then wrapped in the other direction around this same portion of the leg adjacent the finger 162, overlapping the section 158*a*, and the finger is slipped into an eye opening 160 in section 158*b*.

As shown in FIGS. 10, 11, 12, and 13, the user may move the device in any direction. The legs 70*a*, 70*b*, 72*a*, and 72*b* diverge outward in a manner that stabilizes the device 60, so that even if the user falls, the device will still support him or her. The additional use of the harness 150 further insures the safety of the user. When the device is not being used, it is simply folded up as depicted in FIGS. 14 through 17. First, the sleeve 90 is moved from its central position sideways as shown in FIG. 15 and the opposed ends detached. Next, the front brace 105 and hand grips 100 are pushed upward to pivot and be moved into alignment with the leg to which they are pivotally attached, and the cross-bar 104 is collapsed as shown in FIGS. 16 and 17. To unfolded, these steps are reversed.

Safety Support Device With Adjustable Extension Member

Figure 19:
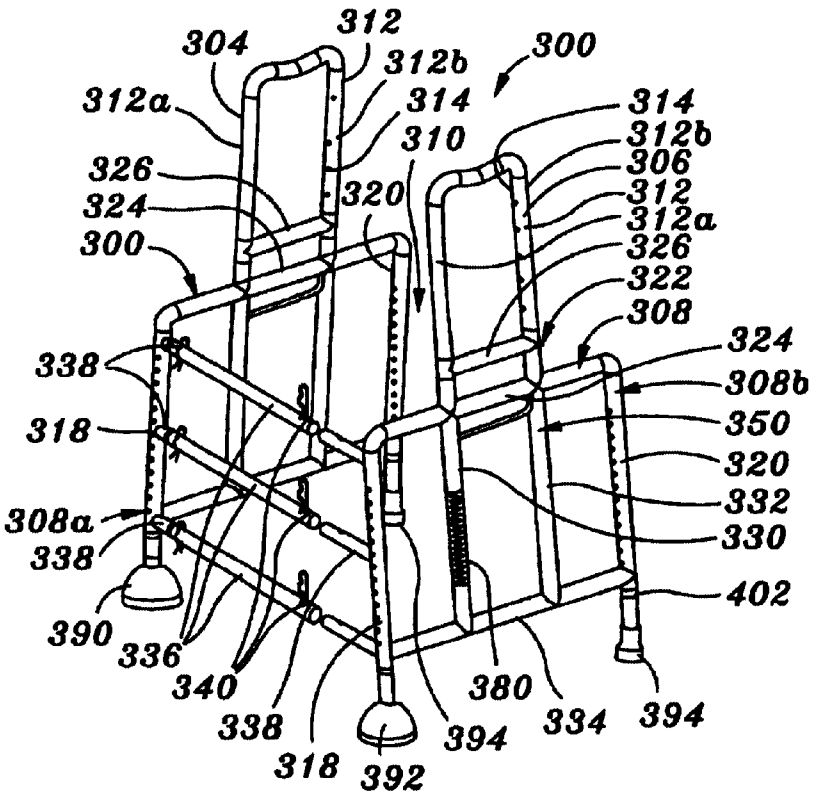
Figure 18:
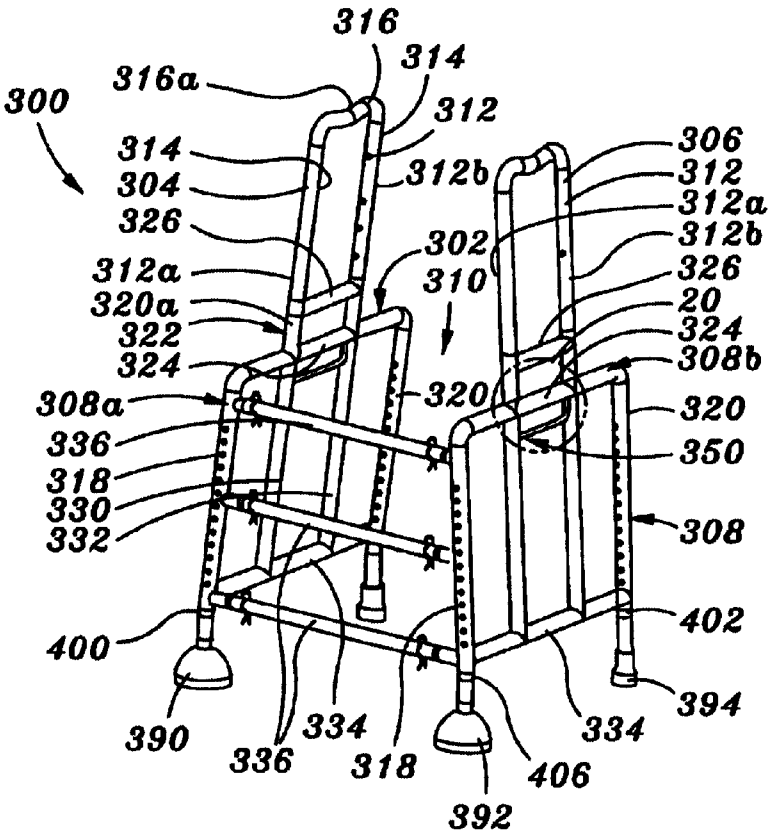

As best illustrated in FIGS. 18 and 19, the third embodiment of this invention, the safety support device 300, comprises a metal frame 302 made of tubular elements and including a pair of spaced apart adjustable underarm support members 304 and 306. Each of these underarm support members 304 and 306 is designed to move up and down relative to a base support 308 with an open rear end 310.

Each under arm support member 304 and 306 comprises an inverted U-shaped tubular structure 312 with a pair of downwardly projecting legs, namely, a forward leg 312*a* and a rear leg 312*b*, each having a series of spaced apart openings 314 along the length of the legs opposite each other. The upper ends of the two legs 312*a* and 312*b* are connected by an integral tubular member 316 having a slight depression 316*a* in it that engages the underarm of the user. The lower ends of the two legs 312*a* and 312*b* extend into the base support.

The base support 308 comprises a pair of spaced apart, essentially identical leg supports 308*a* and 308*b*. Each leg support 308*a* and 308*b* has a pair of outer vertical legs 318 and 320 connected together at their upper ends by a mounting section 322 that includes a tubular member 324 extending between the upper ends of these vertical legs. Centrally located on this tubular member 324 is a pair of upwardly projecting tubes 324*a* and 324*b* connected together by a tubular hand-grip 326. These tubes 324*a* and 324*b* each also have a lower portion extending downwardly to form a pair of inner, left and right hand, parallel vertical supports 330 and 332 having their lower ends connected to a lower cross support tube 334. The mounting section 322 includes the central cross support tube 324. The two opposed forward vertical support legs 318 are connected by pairs of connector tubes 336 that fit snuggly over opposed pairs of aligned tubular elements 338 (FIG. 19) that project outward from each of these forward vertical legs. One end of each aligned tubular element 338 is telescopically received in an open end of each of the connector tubes 336. Clamp pins 338 passing through openings 340 in the connector tubes 336 and tubular elements 338 hold this assembly together.

Figure 21:
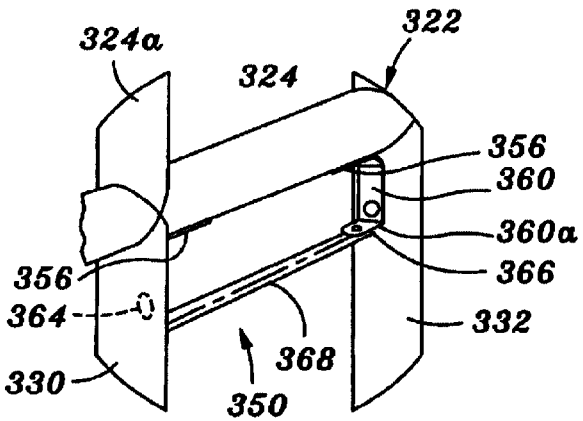
Figure 22:
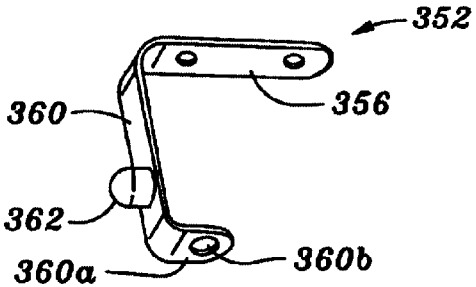
Figure 20:
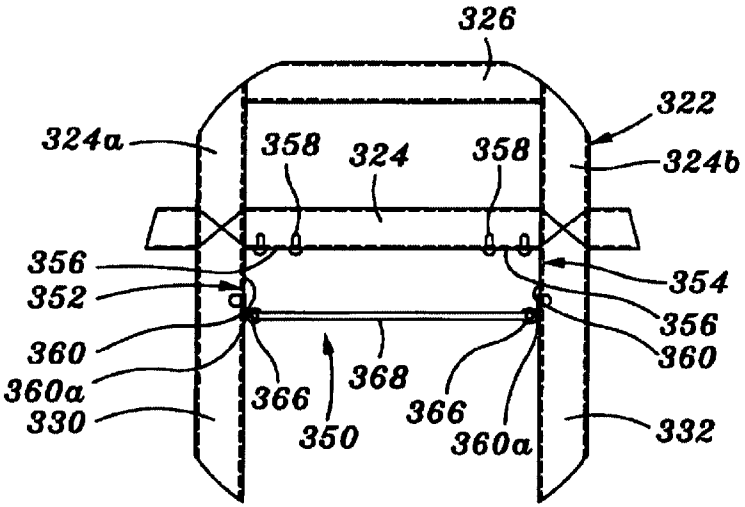
Figure 24:
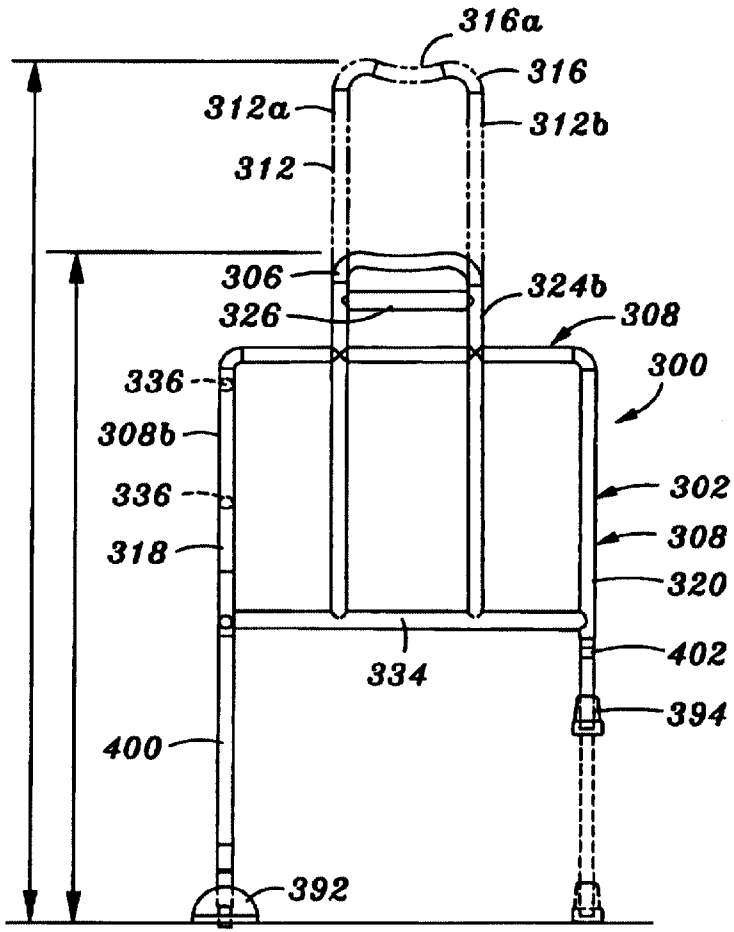
Figure 23:
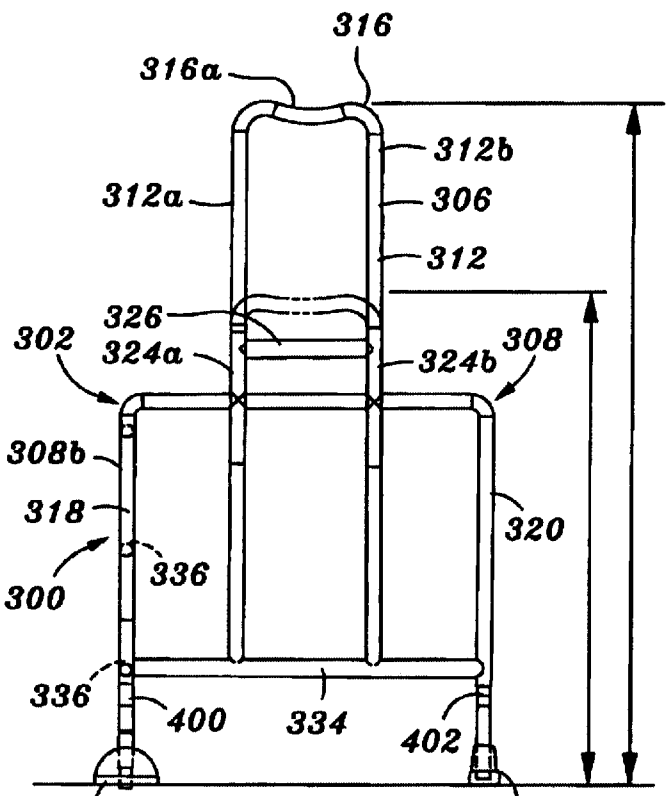

As best depicted in FIGS. 20 through 22, below each mounting section 322 is a release mechanism 350 that enables a user to adjust the height of the under arm support member 304 and 306. Each release mechanism 350 includes a pair of substantially L-shaped metal mounting elements 352 and 354. The left hand mounting element 352 is shown in detail in FIG. 22, and the right hand element 354 is a mirror image of the mounting element 352. Each mounting element 352 and 354 have a horizontal leg 356 each connected by screws 358 to the underside of the tubular member 324. The vertical leg 360 of each mounting element 352 and 354 carries a stop member 362 that is positioned to press against the inside of one of the vertical supports 330 and 332. There is an opening 364 (shown in dotted lines in FIG. 21) in each vertical support 330 and 332 aligned with one stop member 362. The legs 360, respectively bearing against the inside of the inner vertical supports 330 and 332, act as springs to normally urge the stop members into the openings 364 in these legs. On each leg 360 is a short connection piece 360*a* with an opening 360*b* therein for an attachment device 366. The attachment devices 366, e.g. rivets, at opposite ends of a handle 368 secure the handle between opposed connection pieces 360*a* on each leg 360. This handle 368 is made of a rubber-type resilient and flexible material. When the user pulls upward on the handle 368, the stop members 362 are pulled from their respective openings 364, allowing the underarm support members 304 and 306 to be adjusted to move upward or downward as illustrated in FIGS. 23 and 24. Upon release of the handle 368, the stop members will fit into opening 364 and openings 314 in the underarm support members 304 and 306 newly aligned with the openings 364 to hold the underarm support members in the selected position.

As shown in FIG. 19, there are coil springs 380 (only one shown) seated within the left and right hand vertical support members 330 and 332 that normally urge the underarm support members 304 and 306 upwardly to the maximum extended position shown in solid lines in FIG. 23. By manipulating the handle 368 and placing his or her weight on the underarm support members 304 and 306 with the depressions 316*a* of each support member under the user's armpits, the weight of the user will push the underarm support members downward against the force of the spring 380.

Figure 25:
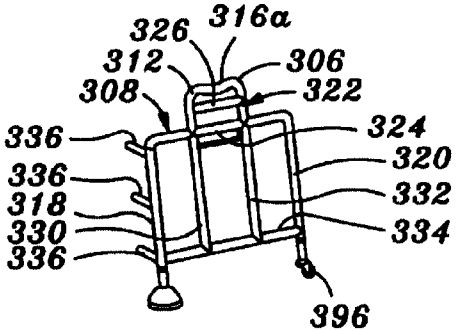

The forward feet members 390 and 392 of the safety support device 300 are preferably equipped with rollers and a brake member as discussed in connection with FIG. 9, and the device may also be equipped with a harness similar to that as illustrated in FIG. 6B. There are forward vertical support tubes 400 and rear vertical support tubes 402 that telescope into the vertical legs 318 and 320. In the embodiment shown in FIGS. 18 and 19, the rear vertical support tubes 402 terminate in stationary feet members 394. In the embodiment shown in FIG. 25, the rear vertical support tubes 402 are equipped with roller casters 396.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A safety support device for supporting a user's body above ground while the user is in an erect standing position, including a frame having a mounting section with a forward end and a rear end, a pair of forward legs attached to the forward end of the mounting section and a pair of rear legs attached to the rear end of the mounting section, a pair of under arm support members attached to the mounting section, each under arm support member being manual adjustable to accommodate different users of varying height, upon adjustment, each said support member engaging an arm pit of the user when the user is being supported by the device, said legs being of a length that enables the user to assume a standing position with the under arm support members beneath the arm pits of the user's arms and user's feet touching the ground, a manually release mechanism associated with each under arm support member that enables the user while standing erect to change the position of the under arm support members to accommodate the height of the individual user, each release mechanism including a stop member that is manually moveable between a first position engaging an associated under arm support member and holding said associated under arm support member in one of a plurality of different positions and a second position allowing the associated under arm support member to be repositioned, each release mechanism including a flexible, resilient handle that is connected to the stop member, said handle being manually manipulated to move the stop member between the first and second positions.

2. The safety support device of claim 1 where the stop member is mounted on a spring element that is loaded upon manual manipulation of the handle and returns to its unloaded condition upon disengaging the handle.

3. The safety device of claim 1 including a harness.

4. A safety support device for supporting a user's body above ground while the user is in an erect standing position, including a frame having a mounting section including an upper end, a forward end, and a rear end, a pair of forward legs attached to the forward end of the mounting section and a pair of rear legs attached to the rear end of the mounting section, a pair of under arm support members attached to the upper end o f the mounting section to move substantially vertically into one selected position including a predetermined elevated position and at least one lower position beneath said predetermined elevated position, each under arm support member being normally biased by a spring member into said predetermined elevated position, a pair of manually actuated release mechanisms, one release mechanism associated with each under arm support member to interact therewith to hold the associated under arm support member in the selected position, each release mechanism including a stop member that is manually moveable between a first position where the stop member engages an associated under arm support member and holds said associated under arm support member in the selected position and a second position allowing the associated under arm support member to be repositioned vertically, said spring urging said associated under arm support member into said predetermined elevated position when the stop member is in the second position.

5. The safety support device of claim 4 where the mounting section includes a first pair of substantially vertical tubular elements and a second pair of substantially vertical tubular elements, and each under arm support member is inverted and substantially U-shaped and includes a pair of substantially parallel legs, the legs of one of the under arm support member extending into the first pair of vertical tubular elements and the legs of the other under arm support member extending into the second pair of vertical tubular elements.

6. The safety support device of claim 4 where each release mechanism includes a flexible, resilient handle that is connected to the stop member, said handle being manually manipulated to move the stop member between the first and second positions.

7. The safety support device of claim 4 where the stop member is mounted on a spring element that is loaded upon manual manipulation of the handle and returns to its unloaded condition upon release of the handle.

8. A safety support device for supporting a user's body above ground while the user is in an erect standing position, including a frame having a mounting section including opposed sides, a n upper end, a forward end, a rear end, a first pair of substantially vertical tubular elements on one side, and a second pair of substantially vertical tubular elements on the other side, a pair of forward legs attached to the forward end of the mounting section and a pair of rear legs attached to the rear end of the mounting section, a first under arm support member attached to the upper end of the mounting section on one side and a second under arm support member attached to the upper end of the mounting section on the other side, said first and second under arm support members being inverted and substantially U-shaped and each including a pair of substantially parallel legs, the legs of the first under arm support member being received in the first pair of vertical tubular elements and the legs of the second under arm support member being received in the second pair of vertical tubular elements, a first spring member seated in a lower portion of at least one tubular element of the first pair of vertical tubular elements and a second spring member seated in a lower portion of at least one tubular element of the second pair of vertical tubular elements, said first spring member urging the first under arm support member into an elevated position and said second spring member urging the second under arm support member into an elevated position, a first manually actuated release mechanism mounted to one side of the mounting section and a second manually actuated release mechanism mounted to the other side of the mounting section, the first release mechanism being manually moveable between a first position holding the first under arm support member in a selected position beneath said elevated position and a second position allowing said first under arm support member to be repositioned vertically, and the second release mechanism being manually moveable between a first position holding the second under arm support member in a selected position beneath said elevated position and a second position allowing said second under arm support member to be repositioned vertically, said first spring member urging said first under arm support member into said elevated position when the first release mechanism is in the second position and said second spring member urging said second under arm support member into said elevated position when the second release mechanism is in the second position.

9. The safety support device of claim 8 where the first release mechanism is positioned between the parallel legs of the first U-shaped under arm support member and the second release mechanism is positioned between the parallel legs of the second U-shaped under arm support member.

10. The safety support device of claim 8 here the first and second release mechanisms each include a flexible, resilient handle.

11. A safety support device for supporting a user's body above ground while the user is in an erect standing position, including a frame including a mounting section having an upper end and support legs, a pair of spaced apart under arm support members each attached to the upper end of the mounting section to move substantially vertically into one selected vertical position from a plurality of different vertical positions a pair of manually actuated release mechanisms, one release mechanism associated with each under arm support member and each being manually moveable between a first position to engage an associated under arm support member and hold said associated under arm support member in the selected vertical position and a second position allowing the associated under arm support member to be repositioned vertically, pair of spring members, each spring member associated one under arm support member to urge said associated under arm support member into a predetermined elevated vertical position.

12. The safety support device of claim 11 where each release mechanism includes a flexible, resilient handle.

13. A safety support device for supporting a user's body above ground while the user is in an erect standing position, including a frame including a mounting section and support legs, a pair of spaced apart under arm support members each attached the mounting section to move substantially vertically, each under arm support member being manual adjustable to accommodate different users of varying height, upon adjustment, each said support member engaging an arm pit of the user when the user is being supported by the device, said legs being of a length that enables the user to assume a standing position with the under arm support members beneath the arm pits of the user's arms and user's feet touching the ground, a manually release mechanism associated with each under arm support member that enables the user while standing erect to change the vertical position of the under arm support members to accommodate the height of the individual user.

14. The safety support device of claim 13 where each release mechanism includes a stop member that is manually moveable between a first position engaging an associated under arm support member and holding said associated under arm support member in one of a plurality of different vertical positions and a second position allowing the associated under arm support member to be repositioned vertically.

15. The safety support device of claim 14 where each release mechanism includes a flexible, resilient handle that is connected to the stop member, said handle being manually manipulated to move the stop member between the first and second positions.

16. The safety support device of claim 13 including pair of spring members, each spring member associated with one under arm support member to normally urge said associated under arm support member into a predetermined elevated vertical position.

* * * * *